US006748983B2

(12) United States Patent
Bausch

(10) Patent No.: US 6,748,983 B2
(45) Date of Patent: Jun. 15, 2004

(54) CONVEYOR FOR BOTTLE-FILLING MACHINE

(75) Inventor: Franz Hubert Bausch, Neunkirchen (DE)

(73) Assignee: SIG Hamba Filltec GmbH & Co. KG, Neunkirchen (DE)

( * ) Notice: Subject to any disclaimer, the term of this patent is extended or adjusted under 35 U.S.C. 154(b) by 0 days.

(21) Appl. No.: 10/347,578

(22) Filed: Jan. 17, 2003

(65) Prior Publication Data

US 2003/0159754 A1 Aug. 28, 2003

(30) Foreign Application Priority Data

Feb. 25, 2002 (DE) ..... 102 07 806
Dec. 13, 2002 (DE) ..... 102 58 703

(51) Int. Cl.[7] ..... B67C 3/24

(52) U.S. Cl. ..... 141/165; 141/1; 141/168; 141/372; 198/470.1; 198/474.1; 198/476.1; 53/300

(58) Field of Search ..... 141/1, 129, 165, 141/168, 369, 372, 373; 198/470.1, 474.1, 476.1, 626.5, 626.6, 877; 53/285, 287, 300

(56) References Cited

U.S. PATENT DOCUMENTS 1,726,479 A * 8/1929 Engle ..... 141/293
5,219,405 A * 6/1993 Weiss ..... 141/149
5,732,528 A * 3/1998 Peronek et al. ..... 53/201
5,896,898 A * 4/1999 Crossdale et al. ..... 141/83
6,283,177 B1 * 9/2001 Naka et al. ..... 141/145
6,343,628 B2 2/2002 Reinecke ..... 141/165
6,382,399 B2 * 5/2002 Simkowski ..... 198/626.1
6,399,901 B1 * 6/2002 Nishino et al. ..... 177/52

* cited by examiner

*Primary Examiner*—J. Casimer Jacyna
(74) *Attorney, Agent, or Firm*—Herbert Dubno; Andrew Wilford

(57) ABSTRACT

A conveyor chain has lower pins and is displaced in steps through a station. Respective pairs of plates have holes fitted to the pins and confronting cutouts together forming seats shaped to fit complementarily around necks of bottles. Horizontally displaceable supports in the station above the chain carry downwardly projecting upper pins. An actuator raises the plates in the station and thereby slides the holes of the plates in the station from the lower pins onto the upper pins. The arms and upper pins are moved apart when the plates are on the upper pins to open up the seat so that a bottle can be fitted to or taken out of the seat. The arms and upper pins are moved together when the plates are on the upper pins to close the cutouts around a bottle positioned between them, and then lowered back down onto the lower pins.

9 Claims, 3 Drawing Sheets

CONVEYOR FOR BOTTLE-FILLING MACHINE

FIELD OF THE INVENTION

The present invention relates to a bottle-filling machine. More particularly this invention concerns a conveyor for a bottle-filling machine and a method of loading bottles onto and removing them from the conveyor.

BACKGROUND OF THE INVENTION

A bottling apparatus as described in U.S. Pat. No. 6,343,628 has a frame and an endless conveyor element on the frame, having a horizontal working stretch extending in a transport direction through a filling station, and carrying a plurality of holder plates each formed with a row of seats adapted to fit snugly around necks of bottles. Couplings releasably secure the holder plates to the conveyor element with the holder plates spaced in the transport direction along the working stretch and the rows extending transverse to the transport direction. Bottles are loaded into the seats upstream of the filling station with mouths of the bottles open upward and the bottles hanging by their necks from the holder plates and are removed from the seats downstream of the filling station. A drive advances the conveyor element stepwise in the transport direction in the working stretch and arrests each of the holder plates in the filling station with the bottles in its seats aligned with the fill tubes. A plurality of stationary upright fill tubes in the filling station above the working stretch are aligned with the seats of the holder plate in the filling station. The plates are lifted in the filling station off the conveyor element to engage the fill tubes down into the respective bottles so they can be filled through the tubes.

Upstream of the filling station the bottles are cleaned and sterilized and downstream of the filling station they are fitted with caps and sealed. This system is particularly useful in filling the bottles with liquids and semiliquids such as yoghurt.

Thus with this system the bottles are held by their necks and are raised by the holders up to insert the fill tubes into them. In this manner it is possible even to align a relatively small bottle mouth perfectly with a filler tube and fill a relatively large bottle with liquid while generating no foam. The holders are lowered synchronously as liquid is introduced into the bottles to keep the liquid level at a constant position relative to the filler tubes. Such an arrangement can work with tall or short bottles easily with the same holder plates.

The conveyor element has in the working stretch an upper surface and the plates have in the working stretches lower surfaces resting on the conveyor element upper surface. The couplings each have according to the invention a vertically extending pin projecting from one of the surfaces and a coupling hole in the other of the surfaces receiving the respective pin. More particularly the pins project and taper upward from the upper conveyor-element surface and the coupling holes are formed in the plates. In addition the conveyor element is formed by a pair of horizontally spaced endless chains each having a succession of the pins. The plates are each transversely elongated and have ends each formed with a respective one of the coupling holes.

Each plate in this system is formed by a pair of separable subplates each formed with a pair of transversely spaced coupling holes. Confronting edges of the subplates have cutouts together forming the seats, and the subplates are pivoted apart at upstream and downstream ends of the working stretch to allow bottles to be loaded in and taken out.

While this arrangement is relatively effective, it still could use some improvement with respect to the loading of the bottles into the seats and taking them out. This is normally done when the seats are just barely open wide enough to allow the bottles to be fitted in and out, requiring the bottles to be moved with great precision. In addition the bottles must be tipped during the loading and unloading, so that an imperfectly closed bottle will spill.

OBJECTS OF THE INVENTION

It is therefore an object of the present invention to provide an improved bottle conveyor.

Another object is the provision of such an improved bottle conveyor which overcomes the above-given disadvantages, that is which allows bottles to be loaded onto and unloaded from it with relative ease.

A further object is to provide an improved method for loading a bottle into and taking a bottle out of a standard plate-type conveyor.

SUMMARY OF THE INVENTION

A bottle conveyor system has according to the invention a chain having a horizontal stretch extending in a transport direction and carrying lower pins spaced apart in the direction and extending upward in the stretch. A drive displaces the chain in steps through a station and stops the chain in the station. Respective pairs of plates have vertically throughgoing holes each fitted to a respective one of the pins and confronting cutouts together forming seats shaped to fit complementarily around necks of bottles. A pair of supports in the station above the chain have respective downwardly projecting upper pins movable generally in the transport direction between a transfer position aligned with respective lower pins of the chain stopped in the station and a spread position. An actuator can raise the plates in the station in the transfer position of the upper pins and thereby slide the holes of the plates in the station from the lower pins onto the upper pins. The arms and upper pins are moved apart into the spread position when the plates are on the upper pins to open up the seat so that a bottle can be fitted to or taken out of the seat when it is thus opened up. The arms and upper pins are moved together into the transfer position when the plates are on the upper pins to close the cutouts around a bottle positioned between them.

Thus with this system it is possible to spread the plates relatively far apart, while still maintaining them under perfect control, so that a bottle can be brought down into position between them or, if the system is used for unloading the conveyor, for moving it out from between them. The system is particularly advantages for polyethylene bottles having an upper small neck region and a relatively fat body, as it allows the wide body part to be moved easily between the carrier plates, either upward or downward. Such bottles can be fed in from above and moved up out of-the conveyor, something that was very difficult or impossible when they had to be loaded in and taken out where the chains move around the end sprockets.

The bottle conveyor system further has according to the invention means for moving a bottle having a neck between a position with the neck aligned with the plates when raised and a position offset vertically therefrom. This bottle mover engages only a bottom surface of the bottle.

The upper pins in accordance with the invention have downwardly tapered lower ends and the lower pins have upwardly tapered upper ends. The pin ends are substantially identically frustoconically tapered. In addition the pins are substantially identically cylindrical except at their ends.

The method of this invention therefore comprises the steps of positioning the plates on the lower pins with the cutouts confronting each other and forming seats and displacing the chain in steps through the station and stopping the chain in the station with the lower pins aligned underneath the upper pins in the transfer position of the upper pins. The plates in the station are raised in the transfer position of the upper pins to slide the holes of the plates in the station from the lower pins onto the upper pins without changing the relative horizontal position of the plates. Then the arms and upper pins are spread with the plates apart into the spread position when the plates are on the upper pins to open up the seat formed by the plates on the upper pins, whereupon a bottle can be fitted to the opened-up seat. Finally the arms and upper pins are closed together into the transfer position with the plates are on the upper pins to close the cutouts around the bottle positioned between them. The plates are then dropped back down to the conveyor for transport away through the sterilizing, filling, capping, and sealing stations. In an end unloading stations these steps are reversed to take the full, capped, and sealed bottle off the conveyor.

The supports and upper pins are displaced symmetrically apart in the station. In addition the supports and upper pins are displaced apart and together parallel to the transport direction.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
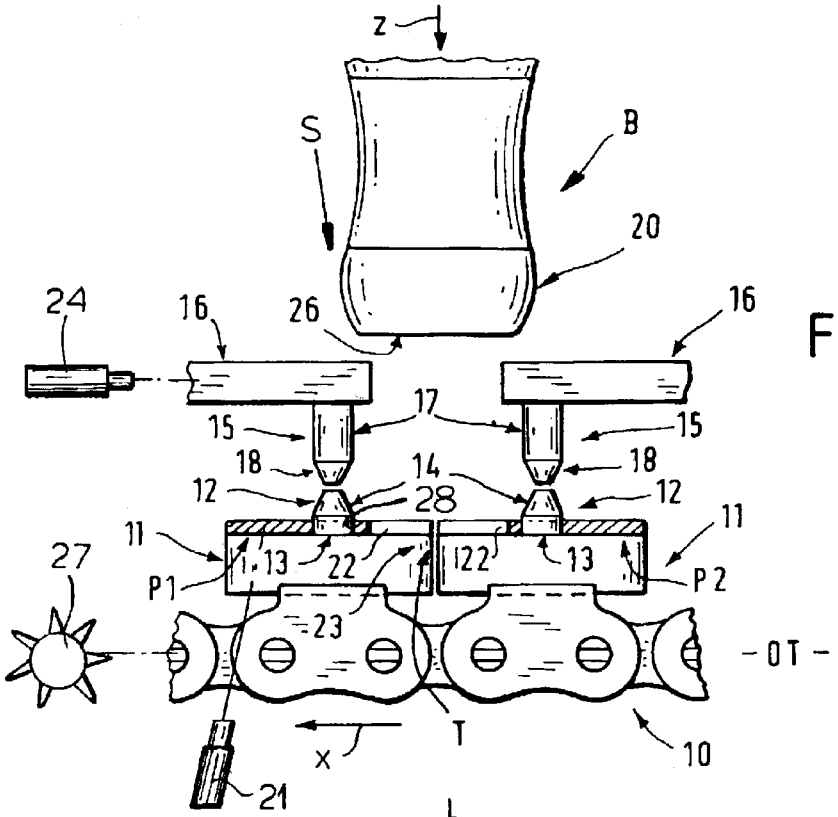
FIG. 1 is a partly diagrammatic side view of the conveyor of this invention in a first step of loading a bottle.

As seen in FIG. 1, a bottle-filling machine such as described in above-cited U.S. Pat. No. 6,343,628 has a conveyor formed by a pair of chains 10 (only one of which is shown in the drawing) each having a horizontal upper stretch OT that is advanced in steps in a horizontal transport direction x by drive means formed in part by downstream sprockets 27 over which the chains 10 pass. The chains 10 are formed at each link with a support 11 carrying an upstanding pin 12 having a cylindrical base 13 and a frustoconical and upwardly tapered tip 14. The pins 12 of the chains 12 are aligned transversely of the travel direction x in pairs. Here portions of the conveyor chains 10 are shown in a loading station S where a bottle B is loaded onto it. Downstream the chains 10 pass through cleaning, filling, capping, and unloading stations spaced apart by the distance through which the conveyor is moved in each step as is well known in the art.

Each pair of pins 12 carries a respective stiff holder plate P1 or P2. The plates P1 and P2 are each formed with at least one semicircular cutout 22 directed, respectively, downstream and upstream so as together to form a circular seat hole 23 at a region or space T between each pair of plates P1 and P2. In practice, each plate P1 and P2 is formed with a row of such cutouts 22 forming a row of seats 23, but for ease of description reference is made to only one such seat 23.

The loading station S is provided with a lifter 25 engageable with a bottom face 26 of a bottle B having an upwardly open mouth M, a circular and inset neck H, and a pair of bulges 19 between the neck H and base 26. This lifter 25 can engage the base 26 by suction to take the bottle B out of a supply and lower it in the illustrated loading station S as will be described below.

The station S is further provided with a pair of support arms 16 that are horizontally displaceable by an actuator shown schematically at 24 in upstream and downstream directions a and b. The arms 16 carry depending pins 15 identical to the pins 12, that is having cylindrical shanks 17 and tapered tips 18. These arms 16 further are displaceable between the transfer position shown in FIGS. 1, 2, 5, and 6 with the pins 15 directly aligned with the respective pins 12 of the chains 10, and a spread position shown in FIGS. 3 and 4 in which they are spaced apart in the transport direction, symmetrically spaced from and flanking the region T in both positions and offset from the respective pins 12.

The plates P1 and P2 are not attached to the chains 12 but normally just sit atop them, with the pins 12 projecting through complementary holes 28 in them. Another actuator shown schematically at 21 can lift the plates P1 and P2 from the lower positions shown in FIGS. 1 and 6 to the upper positions shown in FIGS. 2 through 5.

This system operates as follows:

To start with as shown in FIG. 1, the conveyor chains 10 stop with the pins 12 directly below the pins 15. The arms 16 are in their transfer position with the pins 15 coaxial with the pins 12. The bottle B is suspended above the arms 16 in an unillustrated supply.

Figure 2:
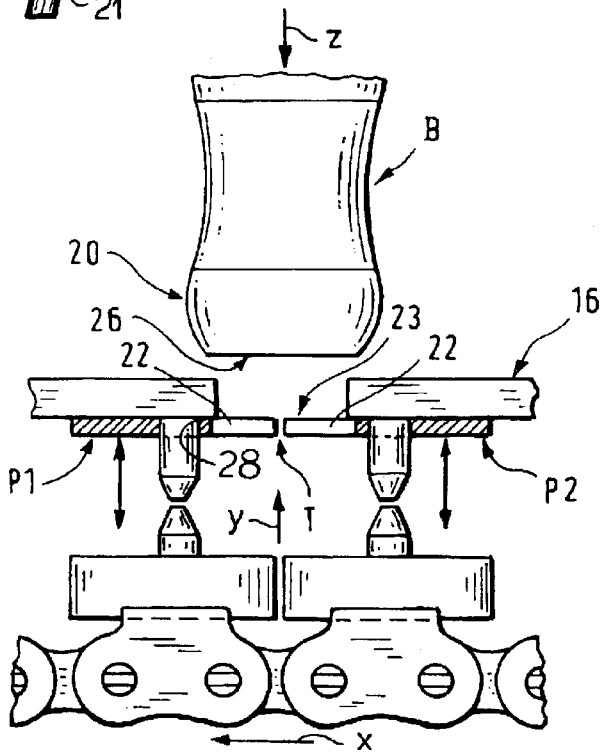
FIGS. 2 through 6 are side views like FIG. 1 showing successive steps in the bottle-loading process.

Then as shown in FIG. 2 the plates P1 and P2 are pushed upward (by the actuator 21 shown only in FIG. 1) against the bottoms of the arms 16, thereby fitting these plates P1 and P2 to the pins 15 but not moving them horizontally at all.

Figure 3:
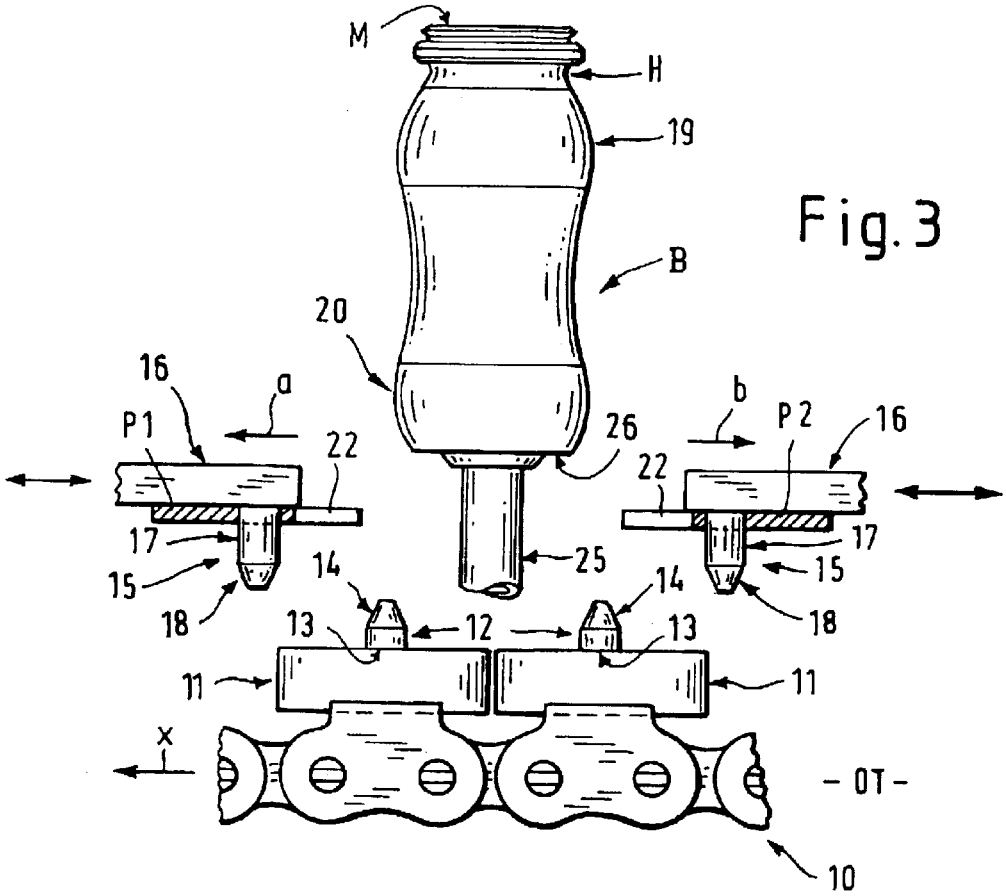

While the plates P1 and P2 are held up on the pins 15 the two arms 16 are spread as shown in FIG. 3 in the upstream and downstream directions a and b (by the actuator 24 shown only in FIG. 1) to open up a large space between the two plates P1 and P2. The lifter 25 then rises Up in a direction y and engages the bottom face 26 of the bottle B.

Figure 4:
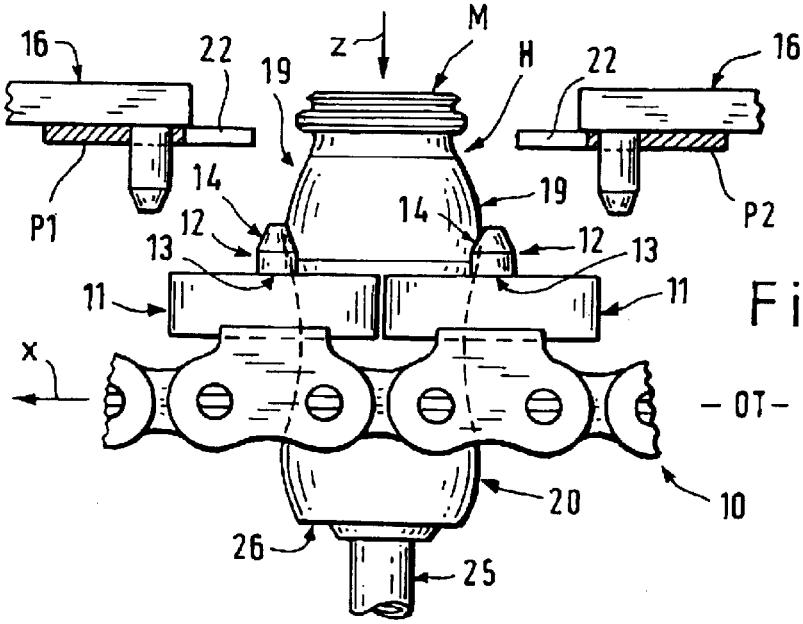

FIG. 4 shows how in the next step the actuator 25 pulls down the bottle B in a direction z between the separated plates P1 and P2 until the bottle neck H is directly positioned between the planes of the raised and spread plates P1 and P2.

Figure 5:
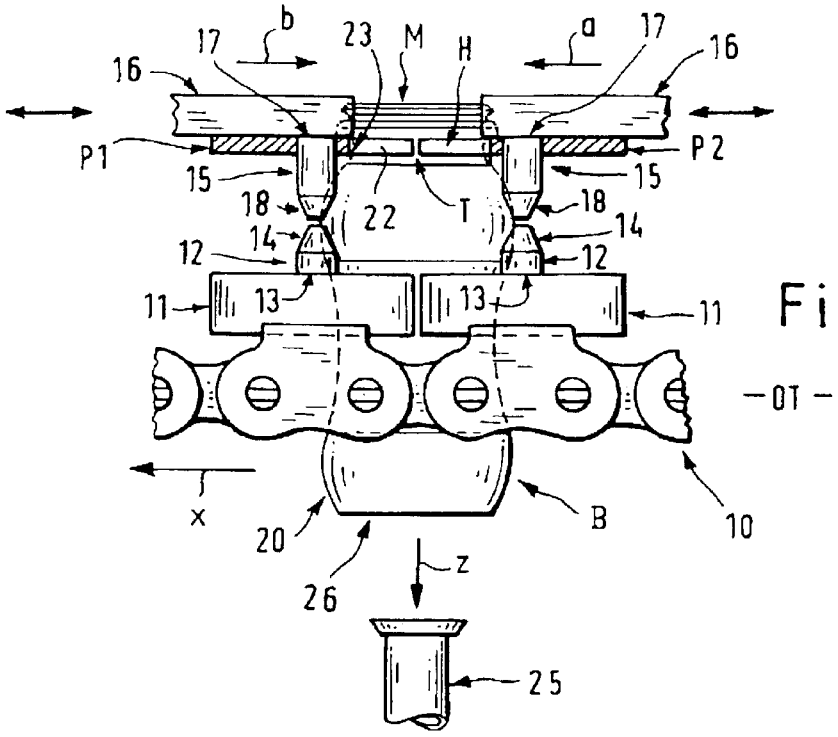

Next as shown in FIG. 5, the actuator 24 pushes the arms 16 back toward each other to fit the cutouts 22 around the neck H as shown in FIG. 5, thereby gripping the bottle B with the plates B1 and B2. This movement also realigns the pins 15 with the pins 12. Once thus engaged the lifter 25 can depressurize and release from the bottom 26, pulling down away from the bottle B and leaving it suspended on the raised plates P1 and P2.

Figure 6:
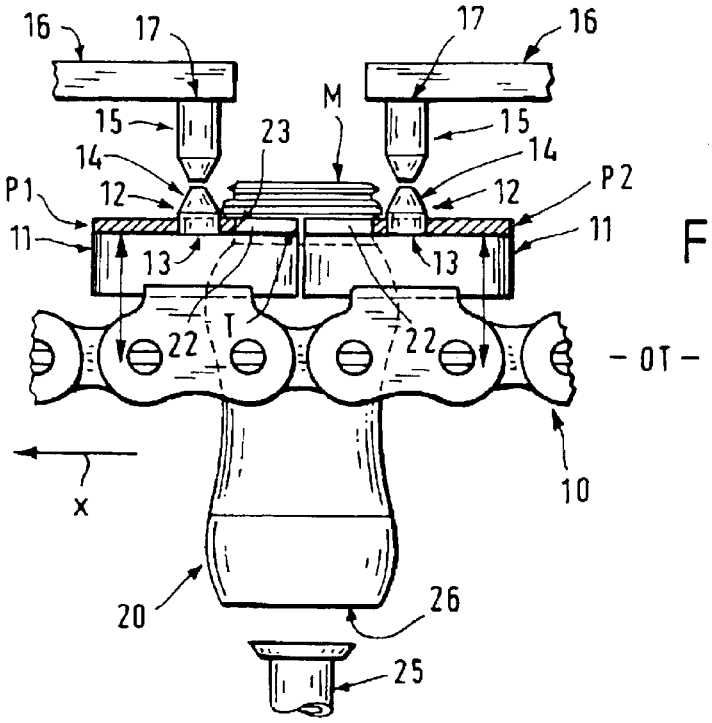

Finally as shown in FIG. 6, the actuator 21 lowers the plates P1 and P2 and the bottle B they grip back down atop the chains 10, fitting the holes 28 to the lower pins 12 and setting the plates P1 and P2 back down on the supports 11. In this position the fixed spacing of the pins 12 prevents the plates P1 and P2 from separating, so that they continue to solidly hold the bottle B.

Thereafter the drive 27 can step the chains 10 to the next station and the cycle can be repeated to load one or more bottles B in the station S onto the conveyor. At the downstream end the steps of FIGS. 1 through 6 are carried out in reverse to separate the cleaned, filled, and capped bottles B from the conveyor.

I claim:

1. A bottle conveyor system comprising:

a chain having a horizontal stretch extending in a transport direction and carrying lower pins spaced apart in the direction and extending upward in the stretch;

means for displacing the chain in steps through a station and for stopping the chain in the station;

respective pairs of plates having vertically throughgoing holes each fitted to a respective one of the pins and confronting cutouts together forming seats shaped to fit complementarily around necks of bottles;

a pair of supports in the station above the chain having respective downwardly projecting upper pins movable generally in the transport direction between a transfer position aligned with respective lower pins of the chain stopped in the station and a spread position;

actuator means for raising the plates in the station in the transfer position of the upper pins and thereby sliding the holes of the plates in the station from the lower pins onto the upper pins; and means for spreading the supports and upper pins apart into the spread position when the plates are on the upper pins and thereby opening up the seat of the plates on the upper pins, whereby a bottle can be fitted to or taken out of the seat when it is thus opened up, and for closing the supports and upper pins together into the transfer position when the plates are on the upper pins to close the cutouts around a bottle positioned between them.

2. The bottle conveyor system defined in claim 1 further comprising means for moving a bottle having a neck between a position with the neck aligned with the plates when raised and a position offset vertically therefrom.

3. The bottle conveyor system defined in claim 2 wherein the bottle-moving means engages only a bottom surface of the bottle.

4. The bottle conveyor system defined in claim 1 wherein the upper pins have downwardly tapered lower ends and the lower pins have upwardly tapered upper ends.

5. The bottle conveyor system defined in claim 4 wherein the pin ends are substantially identically frustoconically tapered.

6. The bottle conveyor system defined in claim 4 wherein the pins are substantially identically cylindrical except at their ends.

7. A method of operating a bottle conveyor having a chain having a horizontal stretch extending in a transport direction through a station and carrying lower pins spaced apart in the direction and extending upward in the stretch;

respective pairs of plates having vertically throughgoing holes each fittable to a respective one of the pins and confronting cutouts shaped to fit complementarily around necks of bottles; and a pair of supports in the station above the chain having respective downwardly projecting upper pins movable generally in the transport direction between a closely spaced transfer position and a widely spaced spread position, the method comprising the steps of:

positioning the plates on the lower pins with the cutouts confronting each other and forming seats;

displacing the chain in steps through the station and stopping the chain in the station with the lower pins aligned underneath the upper pins in the transfer position of the upper pins, raising the plates in the station in the transfer position of the upper pins and thereby sliding the holes of the plates in the station from the lower pins onto the upper pins without changing the relative horizontal position of the plates being raised;

spreading the supports and upper pins with the plates apart into the spread position when the plates are on the upper pins and thereby opening up the seat formed by the plates on the upper pins;

fitting a bottle to the seat when it is opened up;

thereafter closing the supports and upper pins together into the transfer position with the plates are on the upper pins to close the cutouts around the bottle positioned between them; and lowering the plates back down onto the lower pins, whereby the plates with the bottle can be stepped away from the station.

8. The method defined in claim 7 wherein the supports and upper pins are displaced symmetrically apart in the station.

9. The method defined in claim 7 wherein the supports and upper pins are displaced apart and together parallel to the transport direction.

* * * * *